US008045869B2

(12) United States Patent
Kaneyama et al.

(10) Patent No.: US 8,045,869 B2
(45) Date of Patent: Oct. 25, 2011

(54) PRIMARY TRANSFER DEVICE AND IMAGE FORMING APPARATUS HAVING THE SAME

(75) Inventors: Kiyotoshi Kaneyama, Kanagawa (JP); Kazutoshi Sugitani, Kanagawa (JP); Masaaki Takahashi, Kanagawa (JP); Tadakazu Edure, Tokyo (JP); Katsunori Kikuchihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 34 days.

(21) Appl. No.: 12/558,027

(22) Filed: Sep. 11, 2009

(65) Prior Publication Data

US 2010/0150588 A1 Jun. 17, 2010

(30) Foreign Application Priority Data

Dec. 15, 2008 (JP) ..... P2008-318326

(51) Int. Cl.
*G03G 15/16* (2006.01)

(52) U.S. Cl. ..... 399/45; 399/66; 399/302

(58) Field of Classification Search ..... 399/45, 399/66, 82, 302, 308, 317
See application file for complete search history.

(56) References Cited

U.S. PATENT DOCUMENTS

2008/0285989 A1* 11/2008 Yagi ..... 399/66 X
2010/0080589 A1* 4/2010 Yoshioka ..... 399/45

FOREIGN PATENT DOCUMENTS

JP 10-020685 A 1/1998
JP 2006-018096 A 1/2006
JP 2007-033938 A 2/2007
JP 2007-127889 A 5/2007

OTHER PUBLICATIONS

U.S. Appl. No. 12/414,813 entitled "Transfer Device and Image Forming Apparatus." Inventor: Tomoaki Yoshioka; Filed: Mar. 31, 2009; Confirmation No. 1633.

* cited by examiner

*Primary Examiner* — Sophia S Chen
(74) *Attorney, Agent, or Firm* — Morgan, Lewis & Bockius LLP

(57) ABSTRACT

A primary transfer device includes a primary transfer roll that is capable of being engaged with and disengaged from an intermediate transfer member to which a developer image is primarily transferred; and a setting-changing unit that changes a setting of pressure of the primary transfer roll to the intermediate transfer member in accordance with kind of a recording medium to which the developer image is secondarily transferred, wherein the setting-changing unit has an irregular medium transfer mode for a case where the recording medium to which the developer image is a recording medium having irregularities formed on a surface thereof, and an ordinary transfer mode for a case where the recording medium is a recording medium other than the recording medium having the irregularities, wherein a pressure set in the irregular medium transfer mode is smaller than that set in the ordinary transfer mode.

7 Claims, 8 Drawing Sheets

PRIMARY TRANSFER DEVICE AND IMAGE FORMING APPARATUS HAVING THE SAME

CROSS-REFERENCE TO RELATED APPLICATIONS

This application is based on and claims priority under 35 USC 119 from Japanese Patent Application No. 2008-318326, filed Dec. 15, 2008.

BACKGROUND

1. Technical Field

The present invention relates to a primary transfer device and an image forming apparatus provided with the same.

2. Related Art

Usually, as a color image forming apparatus such as a color copying machine or a color printer to which an electro-photographic system is applied, an image forming apparatus of what is called an intermediate transfer system has been known that includes a plurality of image forming units corresponding to colors such as yellow (Y), magenta (M), cyan (C) and black (K). In this image forming apparatus, toner images of the respective colors sequentially formed on photosensitive drums of the image forming units are temporarily primarily transferred in multiple forms to an intermediate transfer member by primary transfer devices respectively opposed to the photosensitive drum. Then, the toner images of the respective colors multiply transferred to the intermediate transfer member are secondarily transferred together to a recording medium by a secondary transfer device. After that, the toner images are heated, pressed and fixed to the recording medium to form a color image. In the primary transfer device in the image forming apparatus using such an intermediate transfer member, primary transfer rolls are respectively arranged so as to be opposed to the photosensitive drums through, for instance, an intermediate transfer belt as an endless type intermediate transfer member to form a primary transfer part, and a pressure contact force and an electrostatic force are allowed to act on the primary transfer part to transfer the toner images formed on the photosensitive drums to the intermediate transfer.

SUMMARY

According to an aspect of the invention, there is provided a primary transfer device including: a primary transfer roll that is capable of being engaged with and disengaged from an intermediate transfer member to which a developer image formed on an image holding member is primarily transferred; and a setting-changing unit that changes a setting of pressure of the primary transfer roll to the intermediate transfer member in accordance with kind of a recording medium to which the developer image primarily transferred to the intermediate transfer member is secondarily transferred, wherein the setting-changing unit has an irregular medium transfer mode for a case where the recording medium to which the developer image is a recording medium having irregularities formed on a surface thereof, and an ordinary transfer mode for a case where the recording medium is a recording medium other than the recording medium having the irregularities, wherein a pressure set in the irregular medium transfer mode is smaller than that set in the ordinary transfer mode.

BRIEF DESCRIPTION OF THE DRAWINGS

Exemplary embodiments of the present invention will be described in detail based on the following figures, wherein.

DETAILED DESCRIPTION

Figure 1:
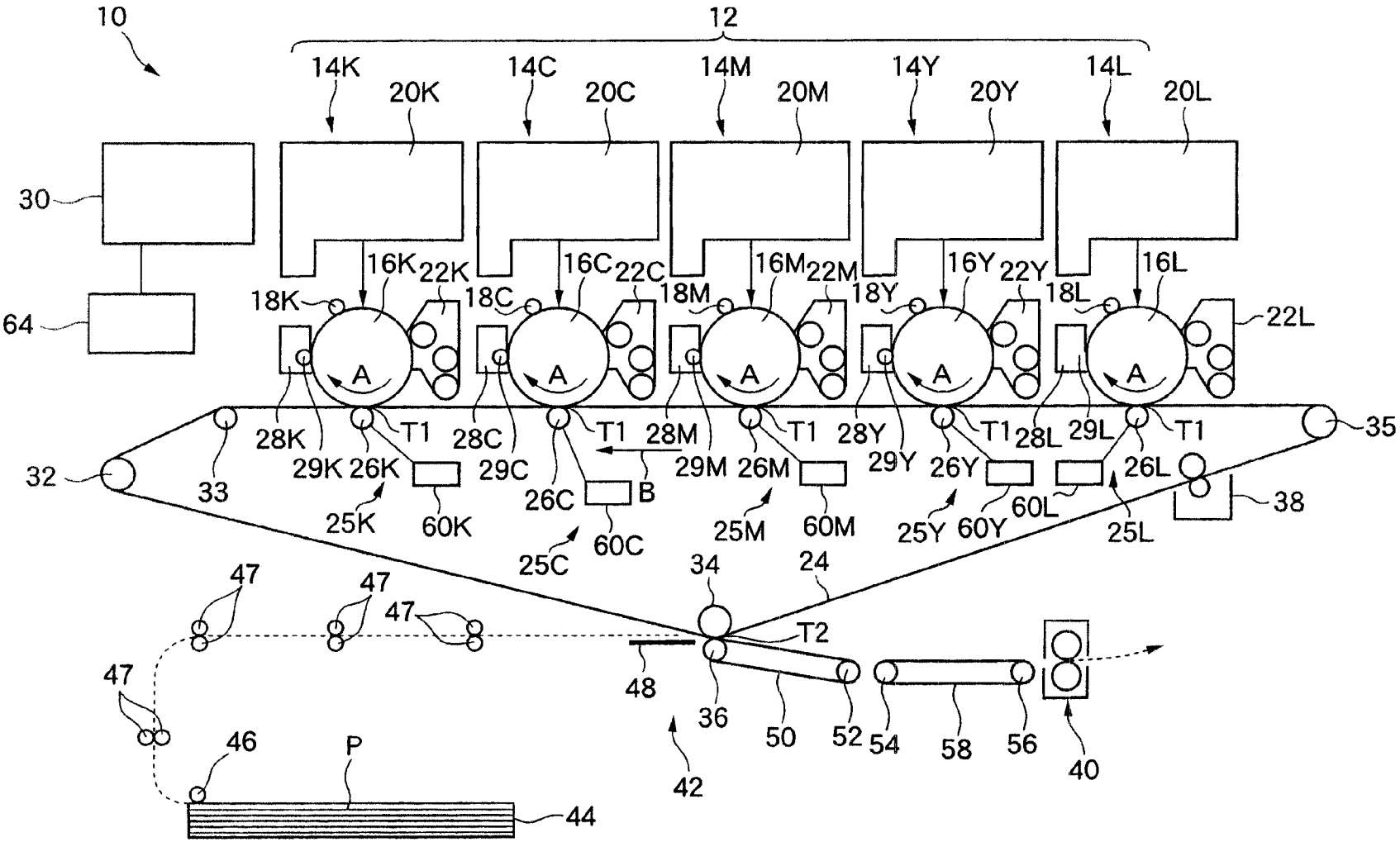
FIG. 1 is a schematic block diagram showing a tandem type image forming apparatus as one example of an image forming apparatus to which the present invention may be applied.

Now, an exemplary embodiment of the present invention will be described below by referring to the drawings.

Initially, a schematic structure of an image forming apparatus to which the present invention may be applied will be described below by referring to FIG. 1. Here, FIG. 1 is a schematic diagram showing the schematic structure of a tandem type image forming apparatus to which the present invention may be applied.

As shown in FIG. 1 the image forming apparatus 10 according to the present exemplary embodiment includes a five-series tandem type image forming part 12 that transfers toner images of respective colors based on inputted image data to an endless belt shaped intermediate transfer belt 24 to form a full color toner image.

The image forming part 12 includes image forming units 14L, 14Y, 14M, 14C and 14K of an electro-photographic system that output images of the respective colors of clear (L), yellow (Y), magenta (M), cyan (C) and black (K) in order from an upstream side in a conveying direction of a recording medium P. The image forming units 14L to 14K are arranged in parallel at prescribed intervals over an upper part of the intermediate transfer belt 24 along the moving direction (a direction shown by an arrow mark B) of the intermediate transfer belt 24.

The image forming units 14L to 14K include photosensitive drums 16L to 16K as image holding members rotated and driven at predetermined speed. The photosensitive drums 16L to 16K are respectively formed by laminating photosensitive layers made of an organic photoconductive member on surfaces (peripheral surfaces) of electrically conductive metal cylindrical members and rotate at predetermined process speed in directions (clockwise) shown by arrow marks A in the drawing. In the present exemplary embodiment, the photosensitive layer is a function separation a type in which a charge generating layer and a charge transport layer are sequentially laminated and ordinarily has a high resistance, however, has a property that the specific resistance of a part irradiated with a laser beam changes when the photosensitive layer is irradiated with the laser beam.

In the peripheries of the photosensitive drums 16L to 16K respectively, are arranged in order from the upstream sides of the rotating directions thereof charging rolls 18L to 18K as charging devices for uniformly charging the surfaces (peripheral surfaces) of the photosensitive drums 16 to a predetermined potential, exposure devices 20L to 20K for applying laser beams (image lights) based on color separated image data (an image signal) to the uniformly charged surfaces (the peripheral surfaces) of the photosensitive drums 16L to 16K to form electrostatic latent images by an exposure, developing devices 22L to 22K for transferring (developing) charged toner (one example of a developer) to the electrostatic latent images to form toner images, an endless belt shaped intermediate transfer belt 24 tightened so as to be circulated in a path in contact with the photosensitive drums 16L to 16K, primary transfer devices 25L to 25K as primary transfer units for transferring the toner images formed on the photosensitive drums 16L to 16K to the intermediate transfer belt 24 and drum cleaning devices 28L to 28K for removing residual toner after a transfer remaining on the surfaces of the photosensitive drums 16L to 16K after the toner images are primarily transferred.

Further, in the drum cleaning devices 28L to 28K according to the present exemplary embodiment respectively, brush rolls 29L to 29K are provided that are pressed to come into contact with the surfaces (the peripheral surfaces) of the photosensitive drums 16L to 16K, and rotated and driven in the directions opposite to the rotating directions of the photosensitive drums 16L to 16K (the directions shown by the arrow marks A) to scrape off the residual toner after the transfer process from the photosensitive drums 16L to 16K.

The primary transfer devices 25L to 25K are respectively arrange inside the intermediate transfer belt 24 and provided at positions respectively opposed to the photosensitive drums 16L to 16K. Further, the primary transfer devices 25L to 25K are respectively provided with primary transfer rolls 26L to 26K. The primary transfer rolls 26L to 26K respectively press the intermediate transfer belt 24 to the photosensitive drums 16L to 16K. Here, contact parts of the photosensitive drums 16L to 16K and the intermediate transfer belt 24 by the primary transfer rolls 26L to 26K are respectively formed as primary transfer parts (primary transfer positions) T1.

Further, the primary transfer devices 25L to 25K according to the present exemplary embodiment are respectively provided with primary transfer bias power sources 60L to 60K for applying primary transfer bias to the primary transfer rolls 26L to 26K.

In the present exemplary embodiment, as the charging devices 18L to 18K, the charging rolls of a contact charging system are used, however, a non-contact charging device such as a scorotron or a solid-state discharge device may be used.

Further, the intermediate transfer belt 24 as an intermediate transfer member is wound on the primary transfer rolls 26L to 26K, a driving roll 32 rotated and driven by a driving source not shown in the drawing, a tension roll 33 for adjusting the tension of the intermediate transfer belt 24, a back-up roll 34 arranged at a below-described secondary transfer part (a secondary transfer position) T2 and a driven roll 35 under a prescribed tension and rotated and moved (circulated) in the direction shown by the arrow mark B synchronously with the rotation of the photosensitive drums 16. The intermediate transfer belt 24 is formed by dispersing materials for applying an electric conductivity such as carbon or an ion conductive material in a resin material for instance, polyimide, polyamide imide, polycarbonate, fluorine resin or the like.

Further, at a position opposed to the back-up roll 34 through the intermediate transfer belt 24, a secondary transfer roll 36 as a secondary transfer unit is provided for transferring the toner images on the intermediate transfer belt 24 to a recording medium P conveyed by a conveying mechanism 42. On the secondary transfer roll 36, a below-described first conveying belt 50 is wound. A contact part of the secondary transfer roll 36 and the intermediate transfer belt 24 through the first conveying belt 50 is formed as the secondary transfer part (the secondary transfer position) T2.

Further, the image forming apparatus 10 according to the present exemplary embodiment includes a belt cleaning device 38 for removing the residual toner after the transfer process that remains on the intermediate transfer belt 24 after the toner images are transferred to the recording medium P by the secondary transfer roll 36 and a fixing device 40 as a fixing unit that fixes the toner images transferred to the recording medium P by the secondary transfer roll 36.

The conveying mechanism 42 includes a pick-up roll 46 for conveying the recording media P accommodated in a sheet tray 44 one sheet by one sheet, a plurality of pairs of conveying rolls 47 provided in a conveying path of the recording medium P, a guide member 48 for supplying the recording medium P to the secondary transfer part (the secondary transfer position) T2, the first conveying belt 50 wound on the secondary transfer roll 36 and a guide roll 52, a second conveying belt 58 arranged in a downstream side of the conveying path of the recording medium P from the first conveying belt 50 and wound on guide rolls 54 and 56 and a sheet discharge tray not shown in the drawing that is arranged in the downstream side of the fixing device 40. In the drawing, reference numeral 64 designates an operating panel and reference numeral 30 designates a device controller. An operation command from the operation panel 64 or operations of component devices are controlled through the device controller 30.

Now, an operation of the image forming apparatus 10 constructed as mentioned above will be described below. Since the image forming units 14L to 14K of the respective colors have substantially the same structure, reference numerals are generally designated hereinafter for the purpose of simplicity (for instance, the primary transfer device 25).

Initially, the surface of the photosensitive drum 16 is uniformly charged to a minus potential by the charging roll 18. The uniformly charged surface of the photosensitive drum 16 is irradiated with the laser beam by the exposure device 20 in accordance with the image data corresponding to each color sent from the device controller 30. Namely, on the photosensitive layer of the photosensitive drum 16, the electrostatic latent image of a print pattern corresponding to each color is formed. Here, the electrostatic latent image is an image formed on the surface (the photosensitive layer) of the photosensitive drum 16 by a charging operation, what is called a negative latent image formed by a phenomenon that, in the photosensitive layer, the specific resistance of the part to which the laser beam is applied is lowered to supply an electrified charge to the surface of the photosensitive drum 16Y, on the other hand, the charge of a part to which the laser beam is not applied remains.

The electrostatic latent image formed on the photosensitive drum 16 is conveyed to a predetermined developing position in accordance with the rotation of the photosensitive drum 16. Then, in the developing position, the electrostatic latent image on the photosensitive drum 16 is changed to a visible image (the toner image) by the developing device 22. In the developing device 22 according to the present exemplary embodiment, is accommodated the toner at least a coloring agent and a binder resin having a volume average particle diameter of 3 μm to 6 μm.

The above-described toner is agitated in the developing device 22 so that the toner is frictionally charged and has an electric charge having the same polarity (−) as that of the electrified charge on the surface of the photosensitive drum 16. Accordingly, when the surface of the photosensitive drum 16 passes the developing device 22, the toner electrostatically adheres only to a de-electrified latent image part on the surface of the photosensitive drum 16 to develop the toner image of each of the colors of clear (L), yellow (Y), magenta (M), cyan (C) and black (K). After that, the photosensitive drum 16 continuously rotates and the toner image of each color developed on its surface is conveyed to the primary transfer part (the primary transfer position) T1.

When the toner image on the surface of the photosensitive drum 16 is conveyed to the primary transfer part (the primary transfer position) T1, a predetermined primary transfer bias is applied to the primary transfer roll 26 from the primary transfer bias power source 60 to form a transfer electric field so that an electrostatic force directed to the primary transfer roll 26 from the photosensitive drum 16 acts on the toner image. Further, since the primary transfer roll 26 is pressed to come into contact with the photosensitive drum 16 through the intermediate transfer belt 24 by a below-described setting changing unit 250 of a pressure contact force, the toner image on the surface of the photosensitive drum 16 is transferred to the surface of the intermediate transfer belt 24. At this time, the primary transfer bias applied to the primary transfer roll 26 has a polarity (+) opposite to the polarity (−) of the toner and is controlled under a constant current by the device controller 30. The toner remaining on the surface of the photosensitive drum 16 after the transfer process is cleaned by the drum cleaning device 28. In such a way, in the image forming units 14L to 14K respectively, the toner images of the respective colors including clear (L), yellow (Y), magenta (M), cyan (C) and black (K) are sequentially and multiply transferred by the primary transfer device 25 so as to be overlapped on the intermediate transfer belt 24.

The intermediate transfer belt 24 that passes the image forming units 14L to 14K respectively and has the toner images of all colors multiply transferred thereto is circulated and conveyed to the direction shown by the arrow mark B in the drawing reaches the secondary transfer part (the secondary transfer position) T2 formed by the back-up roll 34 in contact with the inner surface (a back surface) of the intermediate transfer belt 24 and the secondary transfer roll 36 (the first conveying belt 50) arranged in an image holding surface side of the intermediate transfer belt 24.

On the other hand, the recording medium P is fed to a part between the secondary transfer roll 36 (the first conveying belt 50) and the intermediate transfer belt 24 at a predetermined timing by the conveying mechanism 42 to apply a secondary transfer bias to the secondary transfer roll 36. The secondary transfer bias applied to the secondary transfer roll 36 at tis time has a polarity (+) opposite to the polarity (−) of the toner so that an electrostatic force directed to the recording medium P from the intermediate transfer belt 24 acts on the toner images to transfer the toner images on the surface of the intermediate transfer belt 24 to the surface of the recording medium P. In the present exemplary embodiment, the secondary transfer bias is determined on the basis of a resistance value of the secondary transfer part (the secondary transfer position) T2 and controlled by a constant voltage. After that, the recording medium P is supplied to the fixing device 40. The toner images are heated and pressed so that the toner image whose colors are overlaid (multiply transferred) is molten and permanently fixed on the surface of the recording medium P. Thus, the recording medium P on which a full color image is completely fixed is conveyed to the sheet discharge tray and a series of full color image forming operations are finished.

Figure 2:
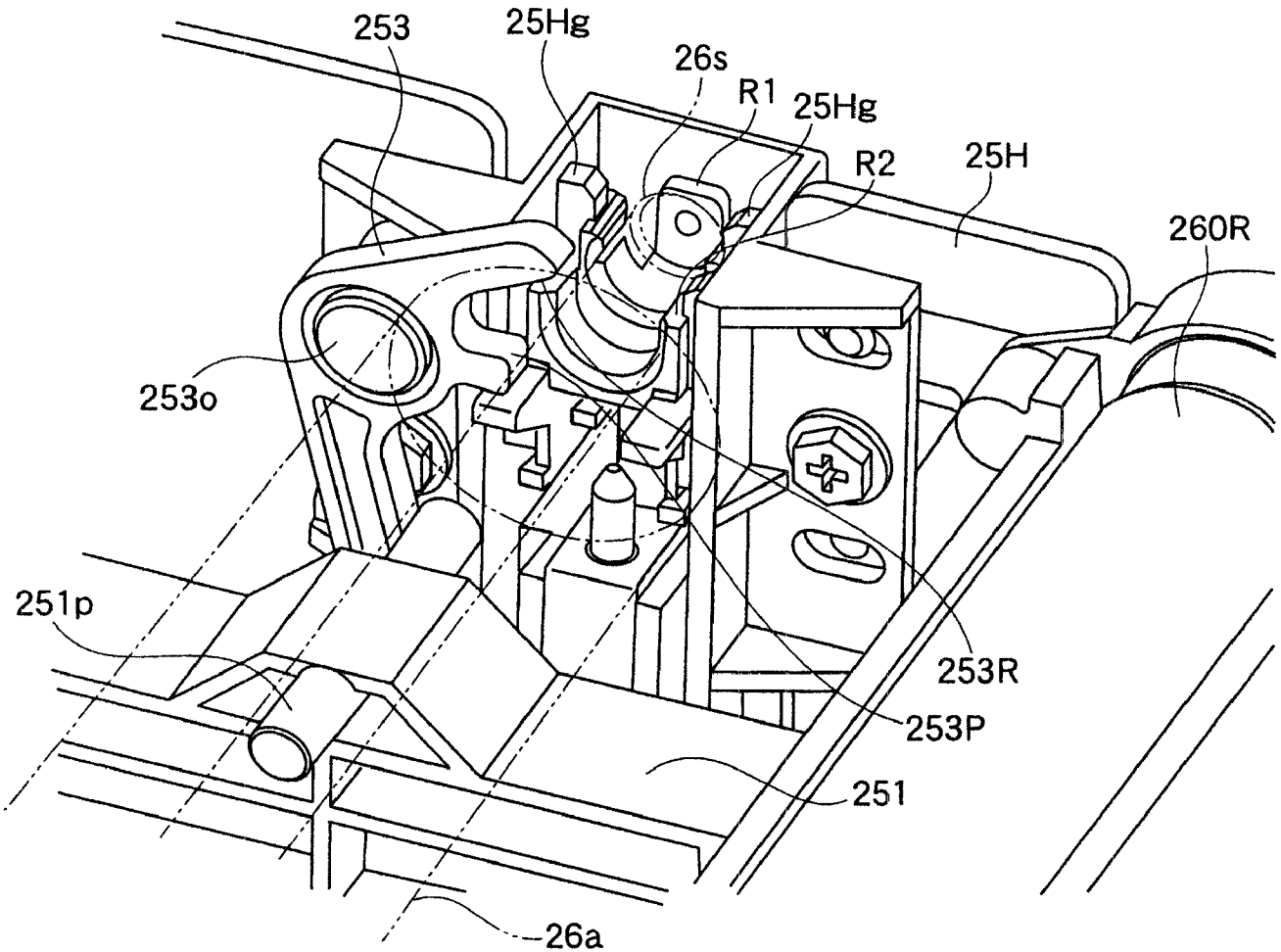
FIG. 2 is a schematic perspective view for explaining a structure of a back surface side of a primary transfer device according to an exemplary embodiment of the invention.
Figure 3:
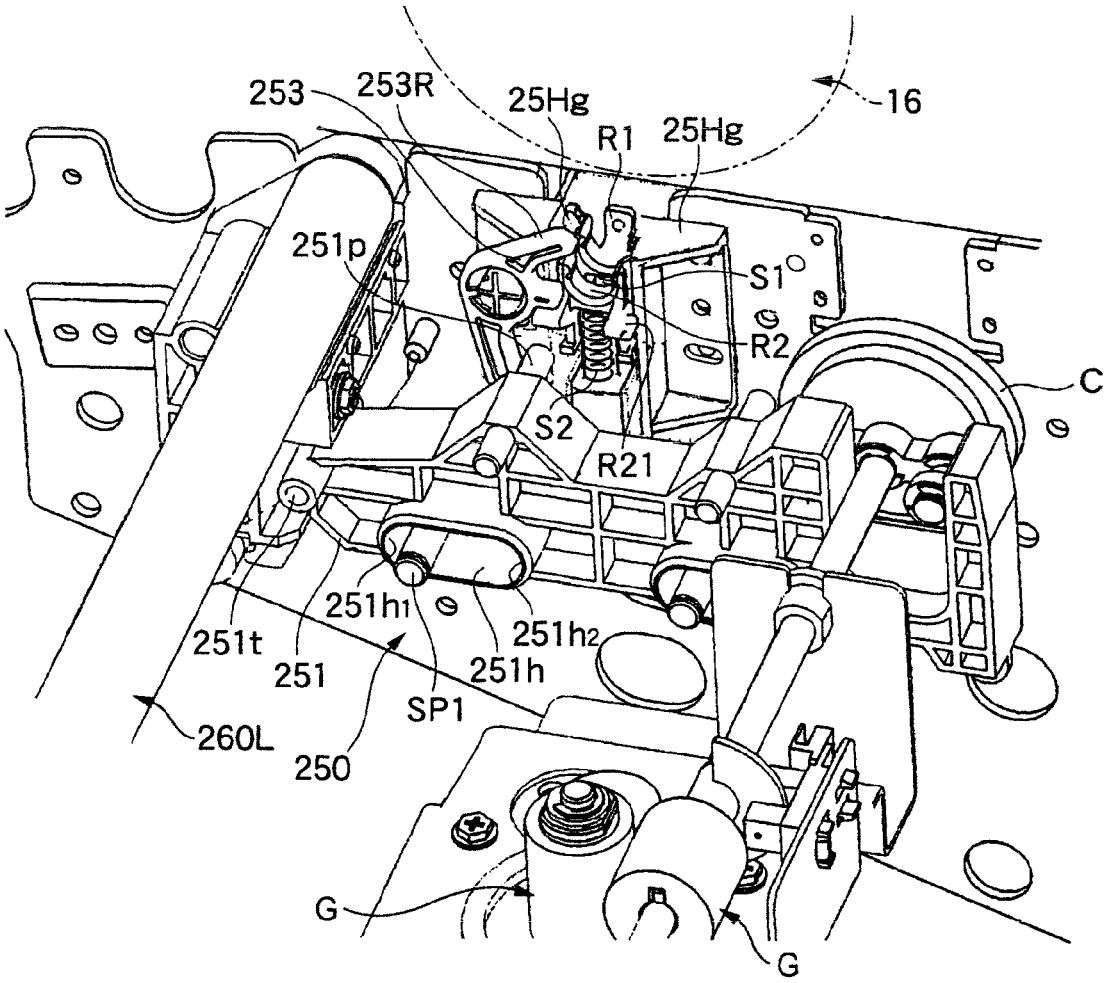
FIG. 3 is a schematic perspective view for explaining the structure of the back surface side of the primary transfer device according to the exemplary embodiment.
Figure 4:
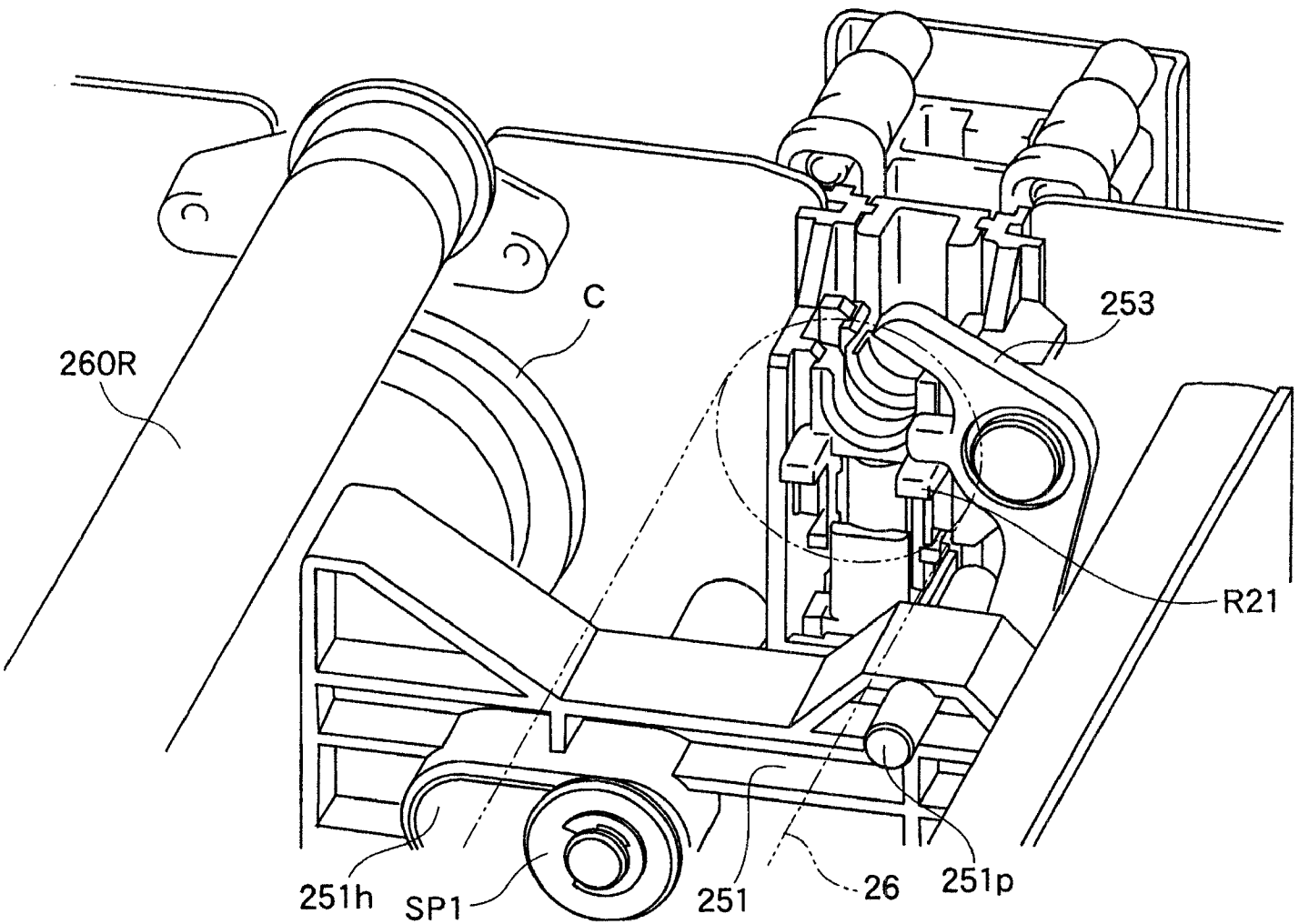
FIG. 4 is a schematic perspective view for explaining a structure of a front surface side of the primary transfer device according to the exemplary embodiment.

Now, a detail of the primary transfer devices 25L to 25K according to the present exemplary embodiment will be further described by referring to FIGS. 2 to 4. Here, FIGS. 2 and 3 are schematic perspective views for explaining the structure of a back surface side of the primary transfer device 25 according to the present exemplary embodiment. For the purpose of clarification, in FIG. 2, the primary transfer roll 26 is shown to be looked through, and in FIG. 3, the primary transfer rolls 26 and a right movable tightening roll 260R are omitted. Further, FIG. 4 is a schematic perspective view for explaining the structure of a front surface side of the primary transfer device according to the present exemplary embodiment. For the purpose of clarification, the primary transfer roll 26 and the right movable tightening roll 260R are shown to be looked through.

As shown in FIGS. 2 to 4, the primary transfer device 25 according to the present exemplary embodiment has similar (symmetrical) driving mechanisms at both end parts in the axial direction (the front surface side and the back surface side of the device) and includes the freely rotating primary transfer roll 26 opposed to the photosensitive drum 16 through the intermediate transfer belt 24, the primary transfer bias power source 60 for applying a predetermined bias current to the primary transfer roll 26, the setting changing unit 250 of the pressure contact force for applying a predetermined pressure contact force to the primary transfer roll 26 and a box shaped housing 25H for accommodating these members inside the intermediate transfer belt 24 to apply the primary transfer bias to the primary transfer roll 26, press the primary transfer roll 26 to come into contact with the intermediate transfer belt 24 side with the pressure contact force whose setting is changed depending on the kind of the recording medium P and primarily transfer the toner image (a developer image) formed on the photosensitive drum 16 to the intermediate transfer belt 24 by the pressure contact force and the electrostatic force.

The primary transfer roll 26 according to the present exemplary embodiment includes a cylindrical roll main body part 26*a* opposed to the photosensitive drum 16 through the intermediate transfer belt 24 to form the primary transfer part T1 and axial end parts 26*s* protruding outside from both the axial end parts of a central axis of the roll main body part 26*a*. The axial end part 26*s* is formed to have a diameter smaller than the outside diameter of the roll main body part 26*a*. Each of both the axial end parts 26*s* is supported so as to freely rotate by a first bearing member R1 having a section of a substantially recessed form and a second bearing member R2 arranged inside in the axial direction of the first bearing member R1. The first bearing member R1 and the second bearing member R2 are formed with an electrically conductive member. In the sides (right and left) of the bearing members R1 and R2 respectively, guide rails 25Hg extending in the vertical direction are formed so that the bearing members may move in the vertical direction along the guide rails 25Hg. Then, between the bottom surface of the first bearing member R1 and the housing 25H opposed to the bottom surface, a first coil shaped spring S1 as a first elastic member is interposed, and between the bottom surface of the second bearing member R2 and the housing 25H opposed to the bottom surface, a second coil shaped spring S2 as a second elastic member is interposed to urge upward the primary transfer roll 26 so as to press the primary transfer roll 26 to the intermediate transfer belt 24 by the compressive and elastic force of the springs respectively. Namely, the primary transfer roll 26 according to the present exemplary embodiment is formed in such a way that both the end parts 26*s* in the axial direction are supported by the four bearing members in total (two first bearing members R1 and two second bearing members R2) that are formed so as to freely move in the vertical direction and is urged by the four corresponding coil shaped springs in total (two first springs S1 and two second springs S2) to be pressed so as to come into contact with the photosensitive drum 16 through the intermediate transfer belt 24. Further, in the present exemplary embodiment, in the second bearing member R2, a pedestal part R21 is provided that protrudes in the axial direction from a part in the vicinity of right and left parts of a lower part of the primary transfer roll 26.

Further, the primary transfer device 25 according to the present exemplary embodiment is provided with a movable tightening roll 260 (in this exemplary embodiment, a left movable tightening roll 260L and a right movable tightening roil 260R arranged at the right and left sides of the primary transfer roll 26) for supporting and tightening the intermediate transfer belt 24 from a lower part in the vicinity of the primary transfer roll 26. The right and left movable tightening rolls 260L and 260R and the primary transfer roll 26, a detail of which will be described below, are integrally driven by a slider 251 movable in the horizontal direction.

In the present exemplary embodiment, the slider 251 as a common driving member is a plate shaped member extending in a transverse direction (a direction orthogonal to the axial direction of the primary transfer roll 26 and provided in the lower parts of both the axial end parts 26*s* of the primary transfer roll 26 respectively. In the vicinity of an end part (a left side end part in FIG. 3) 251*t* of the slider 251, a slot (a through hole) 251*h* extending in a transverse direction is opened. In the through hole 251*h*, a rod shaped roll stopper SP1 is inserted that protrudes inside in the axial direction (in a front side in FIG. 3) from a casing side of the device. On the other hand, the other end part (a right side end part in FIG. 3) of the slider 251 is connected to a stepping motor M through a plurality of gears G or a support cam C so as to be movable (movable forward) in the transverse direction within a movable range until the roll stopper SP1 comes into contact with right and left wall surfaces 251$h_1$ and 251$h_2$ of the slot 251*h* in accordance with the rotation of the stepping motor M.

Further, in an upper part of the slider 251 (in the present exemplary embodiment, in an upper part of the right wall surface 251$h_2$ of the slot 251*h*), a roll shaped driving protrusion 251*p* is provided that protrudes outside in the axial direction (an interior side in FIG. 3). Between the driving protrusion 251*p* and the primary transfer roll 26, an a end part rotating member 253 having a substantially F shaped section is provided.

The end part rotating member 253 is formed so as to freely rotate on a supporting point 253*o* of rotation as a center and has a lower end part that is urged to come into contact with the driving protrusion 251*p* of the slider 251 in a stationary state by a spring not shown in the drawing. On the other hand, in an upper end part of the end part rotating member 253, are provided an arm shaped roll separating part 253R that comes into contact with the axial end part 26*s* of the primary transfer roll 26 from an upper part to press down the primary transfer roll 26 so as to be separated from the intermediate transfer belt 24 and an arm shaped pressure contact force reducing part 253P provided in a lower part of the roll separating part 253R and coming into contact with the pedestal part R21 of the second bearing member R2 to move the second bearing member R2 downward and release the pressure contact force (the elastic force) of the second spring S2.

In the present exemplary embodiment, the right movable tightening roll 260R is mounted on the support cam C so as to come into contact with an outer peripheral surface of the support cam C and moves in the vertical direction in accordance with the rotation of the support cam C.

On the other hand, in the present exemplary embodiment, the left movable tightening roll 260L is attached to a support plate 255 having a supporting point 255*o* of rotation to rotate and move integrally with the support plate 255 on the supporting point 255*o* of rotation as a center. The support plate 255 is urged to rotate in a predetermined direction (in this exemplary embodiment, counterclockwise) in a stationary state by a spring not shown in the drawing. The support plate 255 has a lower end face 255*a* formed to come into contact with a fixed stopper SP2 provided in the casing side of the device so as to regulate a rotating range in the predetermined direction of the support plate 255 (in this exemplary embodiment, counterclockwise). Further, in the support plate 255, a protruding wall 255*w* axially protrudes that comes into contact with the end part 251*t* of the slider 251 in a lower side of the supporting point 255*o* of rotation.

The setting changing unit 250 of the pressure contact force according to the present exemplary embodiment is formed as the similar (symmetrical) driving mechanisms at both the axial end parts 26*s* of the primary transfer roll 26 and includes the slider 251 as the driving member common to the primary transfer roll 26 and the right and left movable tightening rolls 260L and 260R, the end part rotating member 253 for moving the primary transfer roll 26, the support plate 255 for moving the left movable tightening roll 260L, the support cam C for moving the right movable tightening roll 260R and the stepping motor M or gears G for driving these members.

In the image forming apparatus 10 constructed as described above, when the toner image is secondarily transferred to what is called an embossed sheet EP on the surface of which irregularities are mechanically formed, a transfer electric field by the secondary transfer roll 36 acts on the embossed sheet EP in the secondary transfer part T2 so that the toner (the toner images) respectively on the intermediate transfer belt 24 receives the electrostatic force to be attracted to the embossed sheet EP side. However, since distances to the intermediate transfer belt 24 are different in the recessed part and the protruding part of the embossed sheet EP, the level of the transfer electric field is different between the recessed part and the protruding part. Specifically, since the transfer electric field applied to the recessed part of the embossed sheet EP is lower than the transfer electric field applied to the protruding part, the electrostatic force for attracting the toner in the recessed part is lower than that in the protruding part so that what is called a center falling phenomenon arises in which the toner image is not transferred to the recessed part of the embossed sheet EP.

As compared therewith, as recognized from the study of the inventor of the present invention, when the toner image is primarily transferred to the intermediate transfer belt 24, a transfer pressure in the primary transfer part T1 is lowered to previously lower the adhesion of the toner to the intermediate transfer belt 24, so that the toner image primarily transferred to the intermediate transfer belt 24 is easily transferred to the recessed part of the embossed sheet EP in the secondary transfer part T2, and such a center falling phenomenon may be effectively suppressed.

Thus, in the primary transfer device 25 according to the present exemplary embodiment, below-describe operation modes such as an ordinary transfer mode, an irregular medium transfer mode and a retract mode are provided to change the pressure contact force of the primary transfer roll 26 depending on the kind of the recording medium by the setting changing unit 250 of the pressure contact force. Thus, a good secondary transfer performance is ensured irrespective of the kind of the recording medium, and particularly, the secondary transfer performance in the embossed sheet EP is improved.

Figure 5:
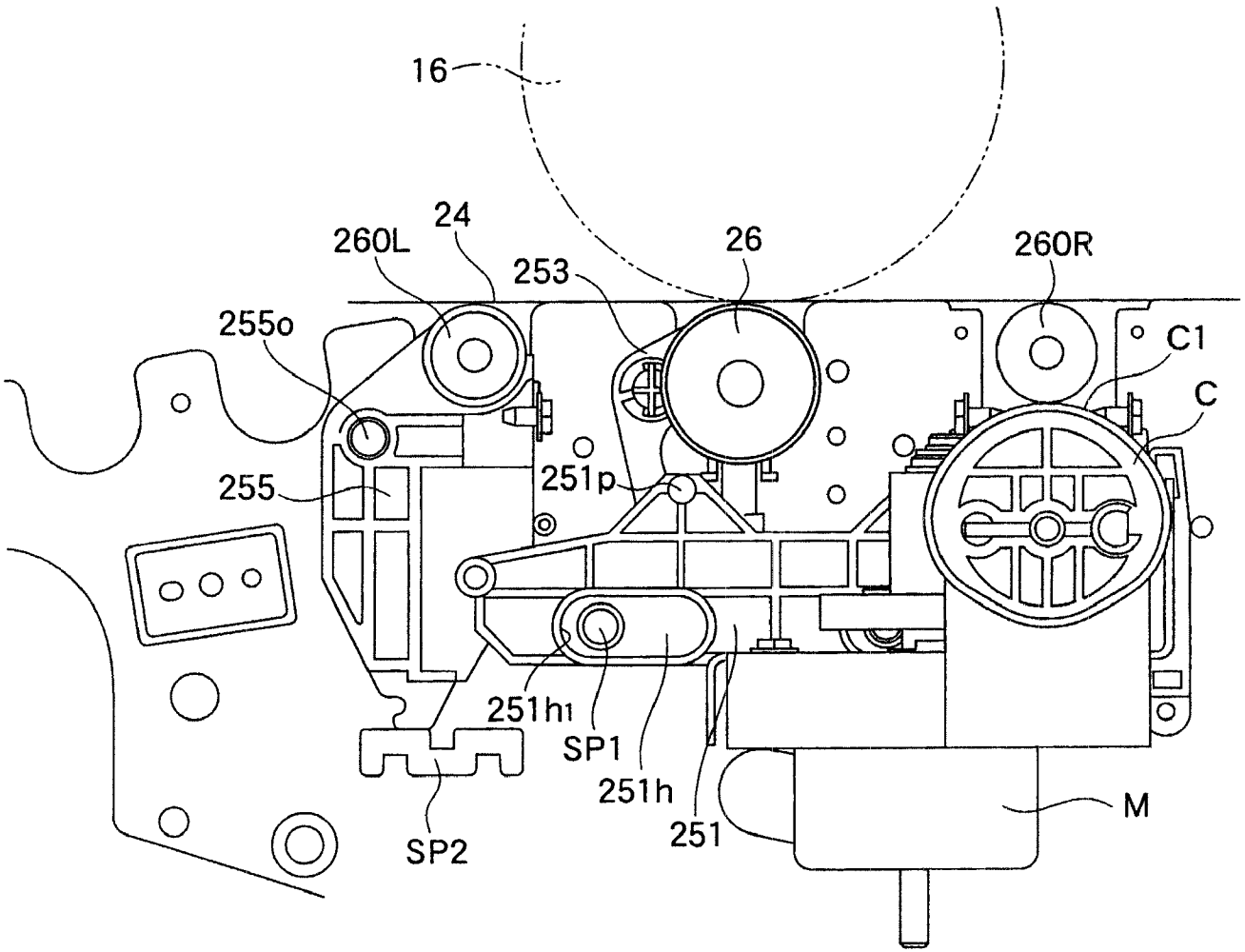
FIG. 5 is a schematic view for explaining operations of component members respectively in an ordinary transfer mode.
Figure 6:
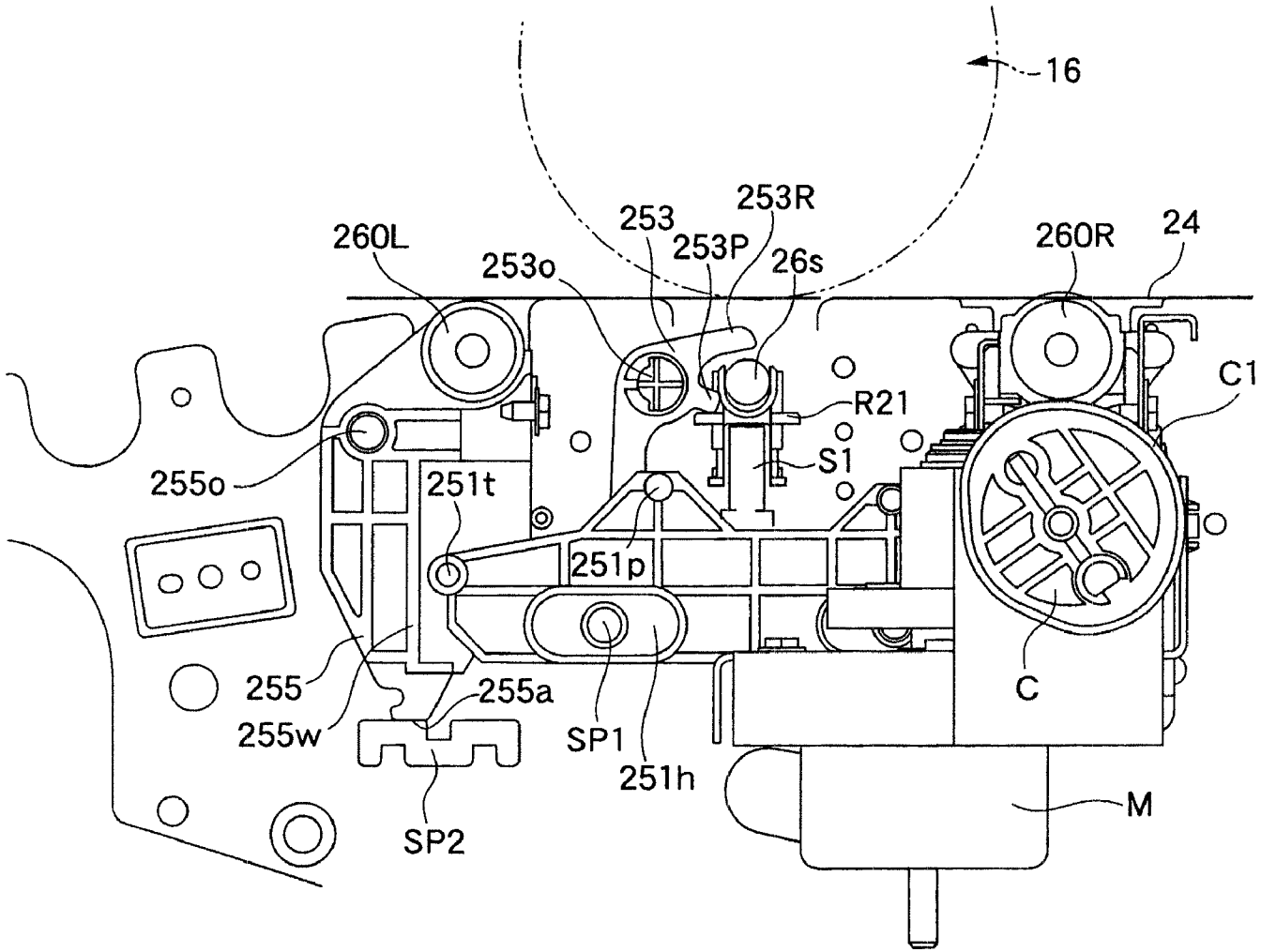
FIG. 6 is a schematic view for explaining operations of component members respectively in an irregular medium transfer mode.
Figure 7:
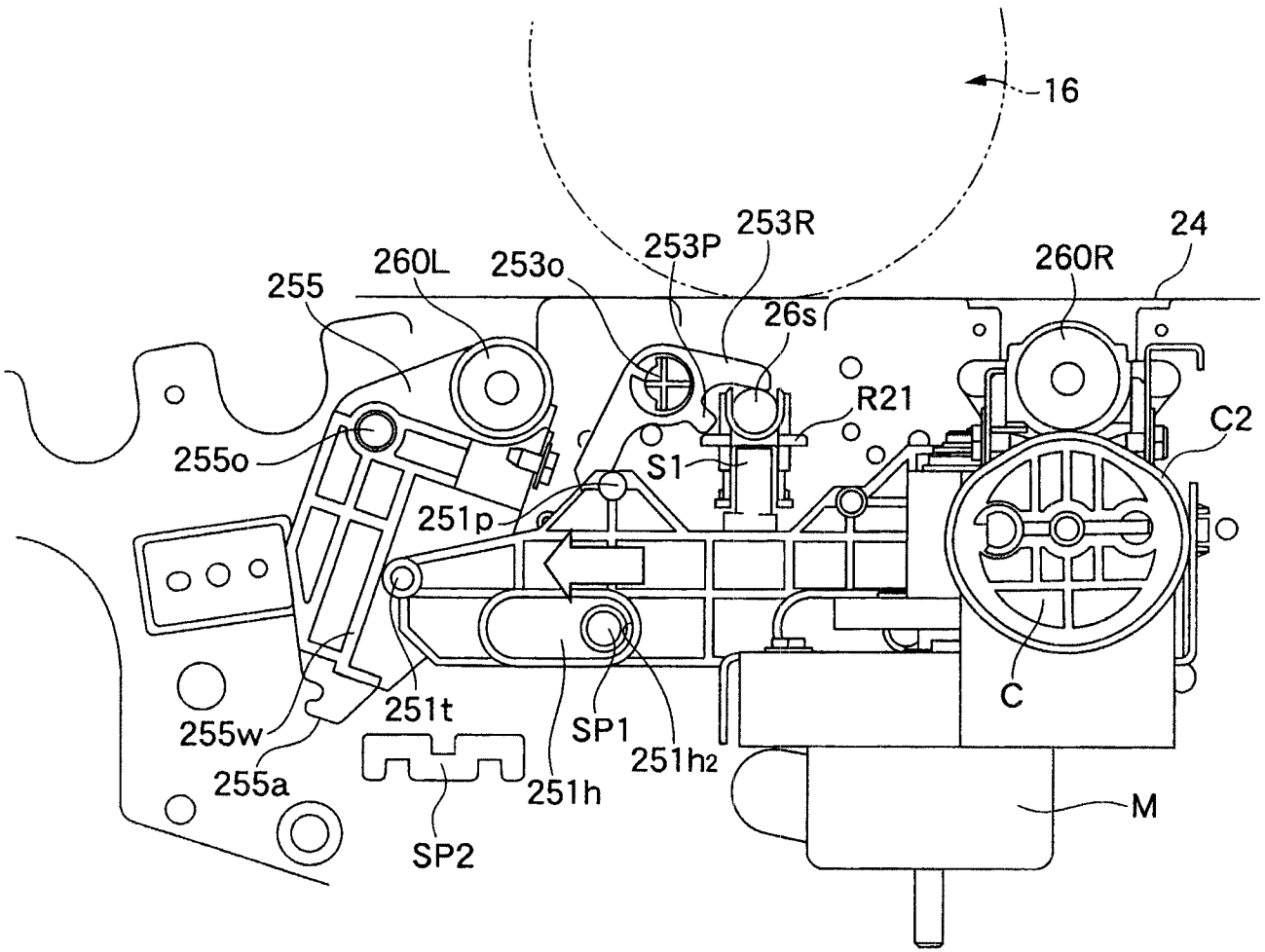
FIG. 7 is a schematic view for explaining operations of component members respectively in a retract mode.

Now, the operation modes of the primary transfer device 25 according to the present exemplary embodiment will be respectively described below by referring to FIGS. 5 to 7. Here, FIG. 5 is a schematic view for explaining the operations of component members respectively in the ordinary transfer mode. FIG. 6 is a schematic view for explaining the operations of the component members respectively in the irregular medium transfer mode. FIG. 7 is a schematic view for explaining the operations of the component members respectively in the retract mode.

As shown in FIG. 5, initially, in the ordinary transfer mode, since the left end part 251$h_1$ of the slot 251*h* of the slider 251 comes into contact with the roll stopper SP1 (the slider 251 is located at the right end of the movable range) and the arm shaped pressure contact force reducing part 253P and the roll separating part 253R of the end part rotating member 253 do not come into contact with the second bearing member R2 and the primary transfer roll 26, the primary transfer roll 26 is pressed to come into contact with the photosensitive drum 16 through the intermediate transfer belt 24 by the elastic force superimposed by the first spring S1 and the second spring S2. At this time, since the support plate 255 does not come into contact with the slider 251, the left movable tightening roll 260L whose position is regulated by the fixed stopper SP2 maintains a contact state with the intermediate transfer belt 24. The right movable tightening roll 260R comes into contact with an equal length surface (a cam surface whose distance from a center of rotation is set to an equal distance) C1 of the support cam C to tighten horizontally the intermediate transfer belt 24 together with the left movable tightening roll 260L and the primary transfer roll 26.

Then, for instance, when the kind of the recording medium P on which the image is formed is inputted from the operating panel 64, and the kind of the recording medium P corresponds to the embossed sheet EP on the surface of which the irregularities are mechanically processed (formed), the ordinary transfer mode is shifted to the irregular medium transfer mode.

In the irregular medium transfer mode, as shown in FIG. 6, the stepping motor M is rotated by a prescribed amount in a predetermined direction (for instance, clockwise) to rotate (in the present exemplary embodiment, clockwise) the support cam C by a predetermined rotating angle through the gear G and move the slider 251 by a predetermined stroke in the horizontal direction (in the present exemplary embodiment, the slider 251 is moved leftward until the position of the roll stopper SP1 is located at a substantially central part of the slot 251*h*). Thus, the driving protrusion 251*p* of the slider 251 comes into contact with the lower end part of the end part rotating member 253 to rotate the end part rotating member 253 to a predetermined direction (in this exemplary embodiment, clockwise) so as to allow the arm shaped pressure contact reducing part 253P to come into contact with the second bearing member R2 and release the pressure contact force of the second spring S2. That is, the primary transfer roll 26 is allowed to come into contact with the photosensitive drum 16 only by the pressure contact force through the first spring S1. At this time, since the right movable tightening roll 260R is located on the equal length surface C1 of the support cam C, its height (position) is maintained. Since the support plate 255 does not come into contact with the slider 251, the left movable tightening roll 260L also maintains its height (position).

In this exemplary embodiment, the pressure contact force of the primary transfer roll in the irregular transfer mode is set to from about 20% to about 30% as high as the pressure contact force of the primary transfer roll in the ordinary transfer mode.

As described above, in the irregular medium transfer mode, a pressing force (the pressure contact force) is lowered more than that in the ordinary transfer mode to previously lower the adhesion of the toner (the toner image) transferred to the intermediate transfer belt 24. Thus, the transfer performance is improved when the toner image is secondarily transferred to the embossed sheet EP.

Further, since the positions (the heights) of the right and left tightening rolls 260L and 260R are maintained and only the pressure contact force of the primary transfer roll 26 may be changed by the single (common) slider 251, the bending of the intermediate transfer belt 24 is prevented and the transfer performance of the embossed sheet EP may be improved without deteriorating the transfer performance to the intermediate transfer belt 24.

Further, since the first spring S1 and the second spring S2 are axially and independently arranged in parallel, the pressure contact force meeting the transfer mode may be set with high accuracy. Since the primary transfer bias may be independently applied to the electrically conductive bearing members R1 and R2 through the springs S1 and S2 respectively corresponding thereto, even when the contact of the one bearing member (in this exemplary embodiment, the second bearing member R2) with the axial end part 26*s* is released, the transfer bias may be applied in a stable way through the other bearing member (in this exemplary embodiment, the first bearing member R1) to stabilize the transfer performance.

Then, when the irregular medium transfer mode is shifted to the retract mode, as shown in FIG. 7, the stepping motor M is further rotated in a predetermined direction (for instance, clockwise) to further move the slider 251 in the horizontal direction (in this exemplary embodiment, leftward in the drawing) and further rotate the end part rotating member 253 to a predetermined direction (in this exemplary embodiment, clockwise). Thus, the roll stopper SP1 comes into contact with the right end part 251*h* of the slot 251*h* of the slider 251 and the arm shaped roll separating part 253R comes into contact with the axial end part 26*s* of the primary transfer roll 26 to separate the primary transfer roll 26 from the intermediate transfer belt 24. At this time, since the right movable tightening roll 260R moves onto a spaced surface C2 of the support cam C (a cam surface whose distance from the center of rotation is set to be shorter than that of the equal length surface C1), its height (position) is low to separate the right movable tightening roll 260R from the intermediate transfer belt 24. The end part 251*t* of the slider 251 comes into contact with the protruding wall 255*w* of the support plate 255 to rotate the support plate 255 (in this exemplary embodiment, clockwise) and separate the left movable tightening roll 260L from the intermediate transfer belt 24. That is, a simultaneous and integral retracting operation of the primary transfer roll 26 and the right and left movable tightening rolls 260L and 260R from the intermediate transfer belt 24 may be realized.

In such a way, the primary transfer roll 26 and the movable tightening rolls 260L and 260R that are engaged with and disengaged from the intermediate transfer belt 24 are formed to operate in cooperation with the operation of the single slider 251 as the common driving member, so that an existing retract mechanism (a mechanism for moving the primary transfer roll 26 so as to be engaged with and disengaged from the intermediate transfer belt 24) of the primary transfer roll 26 may be easily employed.

In the above-described irregular medium transfer mode, the pressure contact force of the second spring S2 of the first spring S1 and the second spring S2 that are axially arranged in parallel is released by the pressure contact force reducing part 253P, however, the elastic forces or arrangements of the springs S1 and S2 may be suitably and arbitrarily set.

Now, a modified example in which the arrangement of a first spring S1 and a second spring S2 is changed will be described by referring to FIG. 8.

In this modified example, the outside diameters of the first spring S1 and the second spring S2 are different from each other and the springs S1 and S2 are concentrically arranged. The same members as those of the exemplary embodiment are designated by the same reference numerals and an explanation thereof will be omitted.

Figure 8:
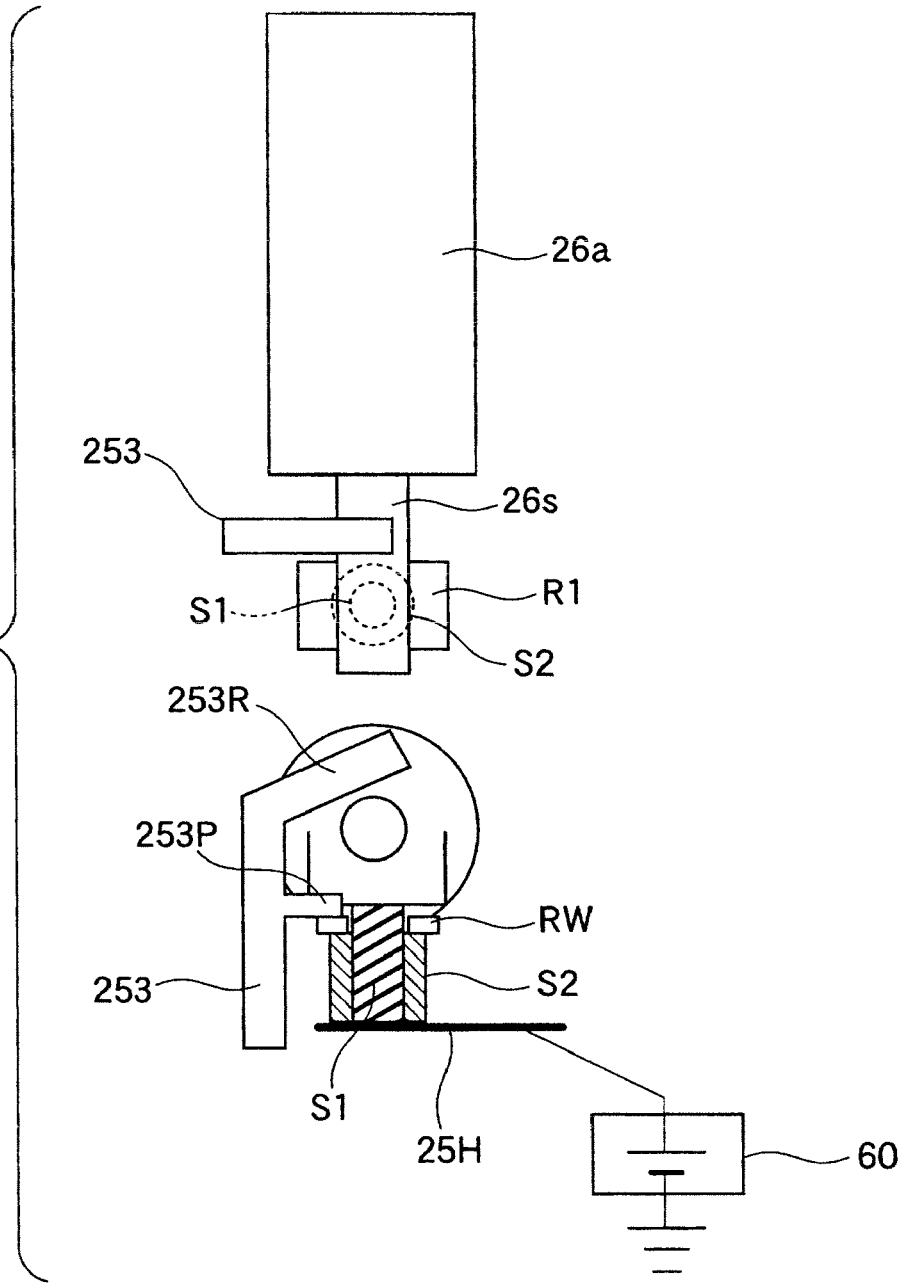
FIG. 8 is a schematic view showing a modified example in which a first spring and a second spring are concentrically arranged.

As schematically shown in FIG. 8, in this modified example, a single electrically conductive bearing member R1 is provided in each axial end part 26*s* of a primary transfer roll 26. Between a bottom surface of the bearing member and a metal plate 25H, the first spring S1 and the second spring S2 are concentrically arranged and a primary transfer bias power source 60 is connected to the metal plate 25H. Specifically, the first spring S1 is arranged inside and the second spring S2 whose outside diameter is formed to be larger than that of the first spring S1 is concentrically arranged outside.

Further, between the outer second spring S2 and the bottom surface of the bearing member R1, a washer Rw is provided that protrudes in the axial direction from the bottom surface of the bearing member R1 and functions as a pedestal part. The washer Rw is allowed to come into contact with an arm shaped pressure contact force reducing part 253P of an end part rotating member 253 to release the pressure contact force of the second spring S2 and switch the pressure contact force in an irregular medium transfer mode.

In such a structure, each axial end part 26*s* of the primary transfer roll 26 is supported by one bearing member R1 so that an axial length may be reduced to make a device compact or reduce a cost.

In the above-described exemplary embodiment, the kind of the recording medium P is inputted from the operating panel 64 to adjust a transfer pressure (the pressure contact force) in the primary transfer part T1. However, the present invention is not limited to such a structure, and, for instance, the kind of the recording medium P may be read by an optical sensor to decide the kind thereof by the device controller 30 and adjust the transfer pressure (the pressure contact force) in the primary transfer part T1. Specifically, before the recording medium P is conveyed to the secondary transfer part T2, the smoothness of the recording medium P is decided by the optical sensor on the basis of a quantity of reflected light. When the smoothness (the quantity of reflected light) is a reference or more, the ordinary transfer mode may be set. When the smoothness (the quantity of reflected light) is lower than the reference, the recording medium P may be decided to be the embossed sheet EP and the irregular medium transfer mode may be set.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A primary transfer device comprising:

a primary transfer roll that is capable of being engaged with and disengaged from an intermediate transfer member to which a developer image formed on an image holding member is primarily transferred; and a setting-changing unit that changes a setting of pressure of the primary transfer roll to the intermediate transfer member in accordance with kind of a recording medium to which the developer image primarily transferred to the intermediate transfer member is secondarily transferred, wherein the setting-changing unit an irregular medium transfer mode for a case where the recording medium to which the developer image is a recording medium having irregularities formed on a surface thereof, and an ordinary transfer mode for a case where the recording medium is a recording medium other than the recording medium having the irregularities, a pressure set in the irregular medium transfer mode is smaller than that set in the ordinary transfer mode, the intermediate transfer member is an endless belt, the primary transfer device further comprises a movable tightening roll that tightens the belt-shaped intermediate transfer member in the vicinity of the primary transfer roll, the primary transfer roll is supported at both ends in an axial direction of the primary transfer roll by elastic members that apply the pressure to the primary transfer roll, and the primary transfer roll and the movable tightening roll are configured to be moved in cooperation with a common driving member that moves in a given direction.

2. The primary transfer device according to claim 1, wherein the elastic members are a first elastic member and a second elastic member, which respectively support the primary transfer roll at the both ends in the axial direction, in the ordinary transfer mode, the setting-changing unit presses the primary transfer roll to the image holding member via the intermediate transfer member by elastic forces of both of the first elastic member and the second elastic member with keeping a contact of the movable tightening roll with the belt-shaped intermediate transfer member, and in the irregular medium transfer mode, the setting-changing unit presses the primary transfer roll to the image holding member via the intermediate transfer member by the elastic force of either the first elastic member or the second elastic member with keeping the contact of the movable tightening roll with the belt-shaped intermediate transfer member.

3. The primary transfer device according to claim 2, wherein the setting-changing unit comprises an end part rotating member in each of the both ends of the axial direction of the primary transfer roll, the end part rotating member rotating in accordance with the common driving member, the end part rotating member has a pressure reducing part that is configured to contact either the first elastic member or the second elastic member to release the pressure corresponding to the contacted elastic member, and has a roll separating part that is configured to contact the end part of the primary transfer roll to move the primary transfer roll so as to be separated from the intermediate transfer member, the pressure of either the first elastic member or the second elastic member is released by the pressure reducing part in accordance with a movement of the common driving member in the given direction, and the movable tightening roll is separated from the intermediate transfer member and the roll separating part of the end part rotating member contacts the end part to separate the primary transfer roll from the intermediate transfer member in accordance with a further movement of the common driving member in the given direction.

4. The primary transfer device according to claim 3, wherein the first elastic member and the second elastic member are arranged respectively in the both ends so as to be adjacent to each other along the axial direction.

5. The primary transfer device according to claim 3, wherein an outside diameter of the first elastic member is differ from that of the second elastic member, and the first elastic member is concentrically arranged with the second elastic member.

6. The primary transfer device according to claim 1, wherein the pressure in the irregular medium transfer mode is set at from about 20% to about 30% of the pressure in the ordinary transfer mode.

7. An image forming apparatus comprising:

the primary transfer device of claim 1; and an image forming unit that forms the developer image on the recording medium.

* * * * *